US005413459A

United States Patent [19]

Woodall et al.

[11] Patent Number: 5,413,459

[45] Date of Patent: May 9, 1995

[54] VERTICLE TURBINE PUMP

[75] Inventors: Richard P. Woodall, Hanoverton; William J. Swetye, Salem; Brian R. Faison, Youngstown; Robert E. Your, Beloit, all of Ohio

[73] Assignee: Crane Co., Salem, Ohio

[21] Appl. No.: 259,352

[22] Filed: Jun. 13, 1994

Related U.S. Application Data

[63] Continuation of Ser. No. 770,972, Oct. 1, 1991.

[51] Int. Cl.[6] ..... F01D 3/00

[52] U.S. Cl. ..... 415/104; 417/420

[58] Field of Search ..... 415/104, 107; 417/359, 417/423.12, 420; 384/303, 912, 907.1

[56] References Cited

U.S. PATENT DOCUMENTS

| | | | |
|---|---|---|---|
| 1,844,620 | 2/1932 | Wintroath | 415/104 |
| 1,876,234 | 9/1932 | Howarth | 384/303 |
| 2,799,227 | 7/1957 | Allen | 417/423.12 |
| 2,996,994 | 8/1961 | Wright | 417/420 |
| 4,998,863 | 3/1991 | Klaus | 417/420 |
| 5,066,200 | 11/1991 | Ooka | 417/420 |
| 5,090,944 | 2/1992 | Kyo et al. | 417/420 |

FOREIGN PATENT DOCUMENTS

| | | | |
|---|---|---|---|
| 5413854 | 2/1979 | Japan | 384/303 |
| 1176812 | 1/1989 | Japan | 384/907.1 |
| 1408116 | 7/1988 | Russian Federation | 415/104 |

OTHER PUBLICATIONS

Crane–Deming Parts Listing re Vertical Turbine Industrial Solvent Pumps, Parts p. 4703–1, dated Mar. 30, 1970.

Franklin Electric Engineering Manual, p. 210.011, dated Jun. 13, 1985.

Peabody Floway Uniset Pump with Thrust Assembly, dated Jan. 14, 1982.

Magnoseal Magnetic Drive Pump brochure, dated Sep., 1989.

Crane CHEMPUMP advertisement (undated).

Inpro/Repulsion Magnetic Seal brochure, dated Jul. 10, 1991.

*Primary Examiner*—Edward K. Look
*Assistant Examiner*—Mark Sgantzos
*Attorney, Agent, or Firm*—Calfee, Halter & Griswold

[57] ABSTRACT

A vertical turbine pump is provided which includes a housing, a magnetic drive assembly attached to the housing, a vertical shaft assembly, an impeller assembly, and a thrust-compensating device. The vertical shaft assembly has an impeller-rotating section, a drive-interfacing section, and a transfer section therebetween. The impeller assembly is mounted to the impeller-rotating section of the shaft assembly and the housing includes a diffuser-bowl section which interfaces with the impeller assembly. The drive-interfacing section of the vertical shaft assembly is situated in a drive-interfacing position and rotational motion is magnetically conveyed from the magnetic drive assembly to the shaft assembly and thus to the impeller. The down-thrust compensating device compensates for down-thrust forces produced by the impeller assembly during rotation thereby maintaining the drive-interfacing end of the vertical shaft assembly in the drive-interfacing position and thereby maintaining the impeller assembly in proper position relative to the diffuser-bowl section of the housing.

16 Claims, 3 Drawing Sheets

VERTICLE TURBINE PUMP

This is a continuation of application Ser. No. 07/770,972 filed on Oct. 1, 1991.

FIELD OF THE INVENTION

This invention relates generally as indicated to a vertical turbine pump. More particularly, the present invention relates to a vertical turbine pump which incorporates a magnetic drive assembly whereby environmentally-contaminating, explosive, and otherwise dangerous fluids may be safely pumped.

BACKGROUND OF THE INVENTION

Chemical manufacturers, energy supply companies, and other industries commonly store large quantities of liquid fluids in tanks, vessels or other receptacles. In many instances, these fluids are environmentally-contaminating, explosive, or otherwise dangerous. For example, certain substances, such as nitric acid, chloride, or ammonia, may environmentally contaminate or otherwise injure surrounding areas. Additionally or alternatively, certain volatile substances, such as gasoline, acetone, alcohols or chlorobenzene, may produce vapors which invite the danger of an explosion.

To supply the demands of the relevant industry, the fluids contained in these receptacles are usually pumped into a service pipe to convey the fluid to a desired location. A vertical turbine pump is usually the preferred, and sometimes also the only feasible, piece of equipment for this purpose. This preference is based on the fact that the storage receptacles are often buried in the ground or situated in other locations which cause the use of horizontal pumps to be impracticable if not impossible. Additionally, pump flow capacity requirements from 50 gpm to 200 gpm, and head requirements to 600 feet, make a vertical turbine pump the only logical and economical choice.

A vertical turbine pump typically comprises a housings a drive assembly attached to the housing, an impeller assembly located within the housing, and a vertical shaft assembly. "Housing" in this context corresponds to the collection of structural components of the pump, other than the drive assembly, the impeller assembly and the shaft assembly. These structural components would commonly include a drive-support portion which supports the drive assembly, a discharge portion which includes a tank-mounting section and which includes the discharge outlet of the pump, and a column portion which includes a diffuser-bowl section and which includes the suction inlet of the pump. Regarding the impeller assembly, it will usually comprise a set (or "stages") of impeller blades.

"Vertical shaft assembly" in this context corresponds to the collection of shaft-like components which transfer power from the drive assembly to the impeller assembly to produce the required hydraulic conditions. In a typical vertical turbine pump, these "shaft assembly" components will include a top or drive-interfacing section which is operatively coupled to (and sometimes actually considered part of) the drive assembly, a transfer section coupled to the top section via a keyed shaft coupling, and a bottom or impeller-rotating section on which the impeller assembly is mounted. Because the drive assembly is located outside of the housing and the impeller assembly is located within the housing, the pump shaft assembly passes through the housing at a point which may be called the "shaft-opening", and a sealing mechanism is required in this area to prevent leakage from the housing.

When the drive assembly rotates the vertical shaft assembly, and thus the impeller assembly, the working fluid is drawn through the suction inlet of the pump and discharged at a higher pressure at the pump discharge outlet. More particularly, fluid is drawn into a central region of each impeller blade and is discharged at a higher pressure and a higher temperature at the blade's periphery. The major portion of the velocity energy is then converted into pressure energy by an impeller-interfacing section of the housing which surrounds the impeller periphery. This impeller-interfacing section of the housing usually comprises a set of complimentary stationary diffusion blades.

A pump may incorporate a mechanical drive assembly having a drive rotor which is mechanically coupled to the pump shaft assembly and which therefore mechanically conveys rotational motion thereto. Such drive assemblies have conventionally been successfully used on both horizontal and vertical pumps. However, the shaft-opening on the pump housing has traditionally been a prime culprit of liquid and/or vapor leakage in mechanical drive pumps. Although mechanical drive vertical turbine pumps have been developed which minimize liquid leakage to an acceptable level, these designs do not eliminate vapor leakage. Consequently, a vertical turbine pump incorporating such a mechanical drive assembly can often not be used in applications where environmental contamination, explosion or other dangerous consequences are a concern.

Certain pumps may alternatively incorporate a magnetic drive assembly. In a magnetic drive assembly, the pump shaft assembly is not mechanically coupled to the drive rotor, and in fact, it does not actually physically contact the drive rotor during operation. Instead, the rotational motion of the drive assembly is "magnetically conveyed" to the pump shaft assembly. The term "magnetically conveyed" in this context corresponds to a conveyance of motion between two components in which essentially the only conveying force is magnetic in nature.

In a typical magnetic drive pump, a first magnetic member, which is annular in shape, is fixedly attached to the rotor; while a second magnetic member is attached to the drive-interfacing end of the shaft assembly. The drive-interfacing end of the shaft assembly is situated in a drive-interfacing position within the rotor, or within the opening defined by the first annular member. The magnetic members are specifically designed so that magnetic forces therebetween are such that when the shaft assembly is placed in a drive-interfacing position, rotational motion of the rotor will magnetically convey rotational motion to the pump shaft assembly.

Chempump Inc. (a subsidiary of the same parent company as the assignee of this application) and other manufacturers have successfully developed a magnetic drive assembly which eliminates liquid and vapor leakage usually associated with the shaft assembly-opening in the pump housing. However, unfortunately, such magnetic drive assemblies cannot be incorporated into vertical turbine pumps due to "down-thrust" complications. "Down-thrust" is the summation of impeller and gravity forces acting in the axial, and downward, direction, and such forces are quite significant, in high-head vertical pumps. Although down-thrust complications may be easily remedied in a mechanical drive pump by the design of the mechanical rotor-shaft connection, such a simple cure is not available for magnetic drive pumps because the pump shaft assembly is not mechanically connected to the drive rotor.

Applicants therefore believe that a need remains for a vertical turbine pump which incorporates a magnetic drive assembly whereby environmentally-contaminating, explosive, and otherwise dangerous fluids may be safely pumped.

SUMMARY OF THE INVENTION

The present invention provides a vertical turbine pump which incorporates a magnetic drive assembly whereby environmentally-contaminating, explosives and otherwise dangerous fluids may be safely pumped. This incorporation of a magnetic drive assembly is made possible by the inclusion of a down-thrust compensating device which compensates for the down-thrust forces produced by the pump's impeller assembly during the pumping process.

More particularly, the present invention provides a vertical turbine pump which includes a housing, a magnetic drive assembly attached to the housing, a vertical shaft assembly, an impeller assembly, and a thrust-compensating device. The vertical shaft assembly has an impeller-rotating section, a drive-interfacing section, and a transfer section therebetween. The impeller assembly is mounted to the impeller-rotating section of the shaft assembly and the housing includes an impeller-interfacing, or diffuser-bowl, section which interfaces with the impeller assembly. The drive-interfacing section of the vertical shaft assembly is situated in a drive-interfacing position whereat rotational motion is magnetically conveyed from the magnetic drive assembly to the shaft assembly and thus to the impeller assembly. The down-thrust compensating device compensates for down-thrust forces produced by the impeller assembly during rotation thereby maintaining the drive-interfacing end of the vertical shaft assembly in the drive-interfacing position and thereby maintaining the impeller assembly in proper position relative to the impeller-interfacing section of the housing.

In the preferred form of the invention, the thrust-compensating device is installed on the transfer section of the vertical shaft assembly and includes a thrust bearing assembly. The thrust bearing assembly includes a thrust block which is fixedly coupled to the shaft assembly, a carbon shoe fixedly coupled to the thrust block, and a set of steel seats fixedly coupled to the housing. A space exits between the shoes and the seats and the pump further includes a lubricating system which supplies lubricating fluid to the space. The pump also may include an impeller-adjusting device which selectively adjusts the shaft assembly, and thus the impeller assembly, in a vertical direction.

These and other features of the invention are fully described and particularly pointed out in the claims. The following descriptive annexed drawings set forth in detail one illustrative embodiment. However this embodiment is indicative of but one of the various ways in which the principles of the invention may be employed

DETAILED DESCRIPTION

Figure 1:
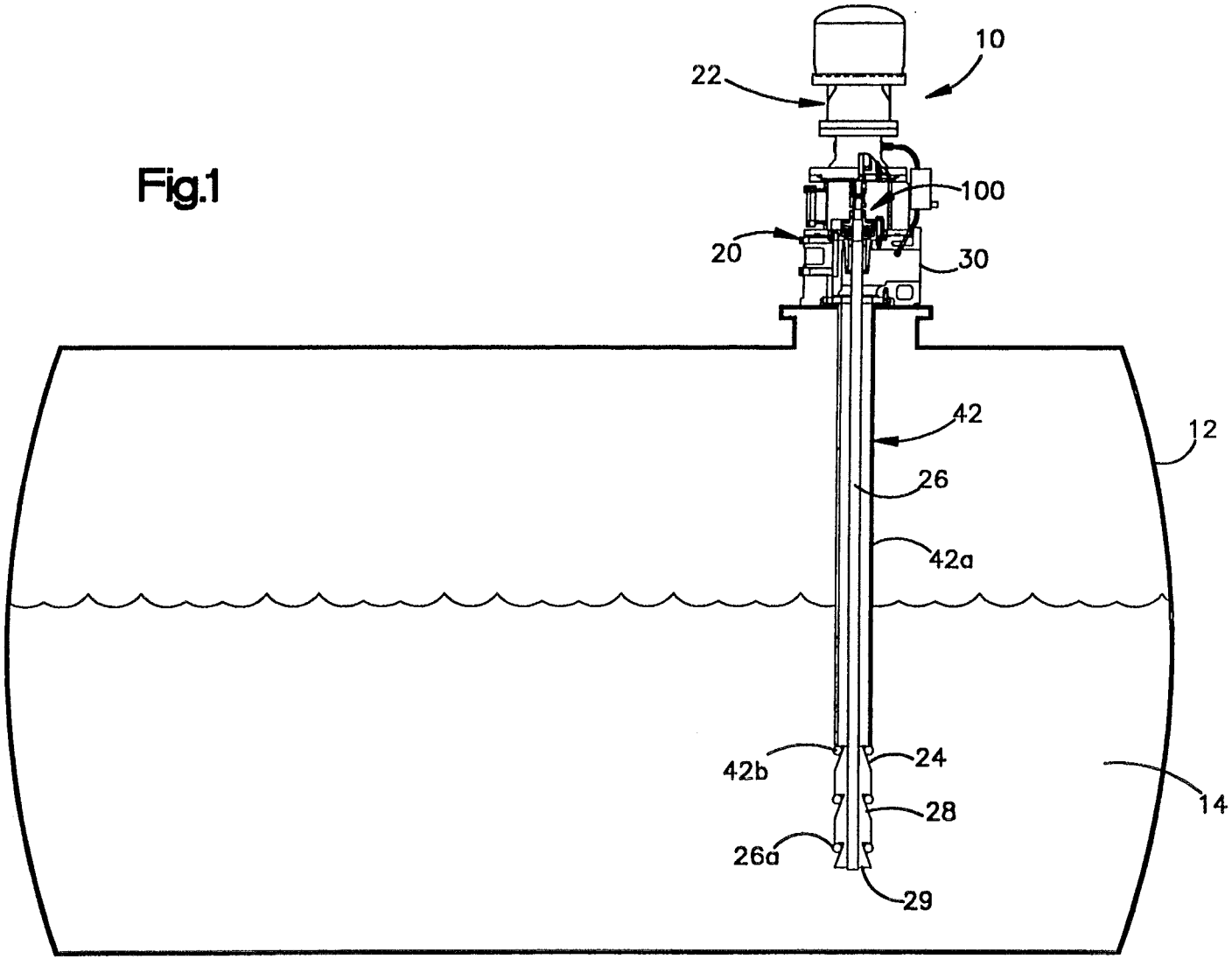
FIG. 1 is side view of a vertical turbine pump according to the present invention, the pump being shown installed in a fluid tank.

Referring now to the drawings in detail and initially to FIG. 1, a vertical turbine pump according to the present invention is indicated generally at 10. The pump 10 is shown installed in a tank 12 containing a liquid fluid 14. In a typical application, the tank 12 would, for instance, be buried in the ground, and the pump 10 would pump the fluid 14 from the tank into a service line (not shown). The pump 10 preferably has a flow capacity greater than 50 gpm and is especially designed so that the pumping process will occur without any liquid or vapor leakage of the fluid 14. Consequently, the pump 10 may be safely used with environmentally contaminating, explosive, or otherwise dangerous fluids.

The vertical turbine pump 10 generally comprises a housing 20, a drive assembly 22 attached to the housing 20, an impeller assembly 24 located within the housing 20, and a vertical shaft assembly 26. One end section of the shaft assembly 26 serves as an axial mount for the impeller assembly 24, or more particularly for a set (or "stages") of impeller blades 28. The opposite end section of the shaft assembly 26 interfaces with the drive assembly 22 whereby rotational motion may be conveyed from the rotor of the drive assembly 22 to the vertical shaft assembly 26, and thus the impeller assembly 24. In this manner, when the drive assembly 22 rotates the vertical shaft assembly 26, the fluid 14 is drawn through the suction inlet 29 of the pump and discharged at a higher pressure at the pump discharge outlet 30.

The vertical turbine pump 10 additionally includes a down-thrust compensating device 100 which, as is explained in more detail below, compensates for the down-thrust forces produced by the impeller assembly 24 during the pumping process. The inclusion of the down-thrust compensating device 100 allows the pump 10 to incorporate a drive assembly 22 in which rotational motion is magnetically rather than mechanically conveyed to the pump shaft assembly 26. In other words, the down-thrust compensating device permits the pump 10 to incorporate a magnetic drive assembly 22. In the preferred embodiment, the magnetic drive assembly 22 comprises a vertical "C" face explosion proof motor 22A and a Mag Drive Unit 22B.

Figure 2:
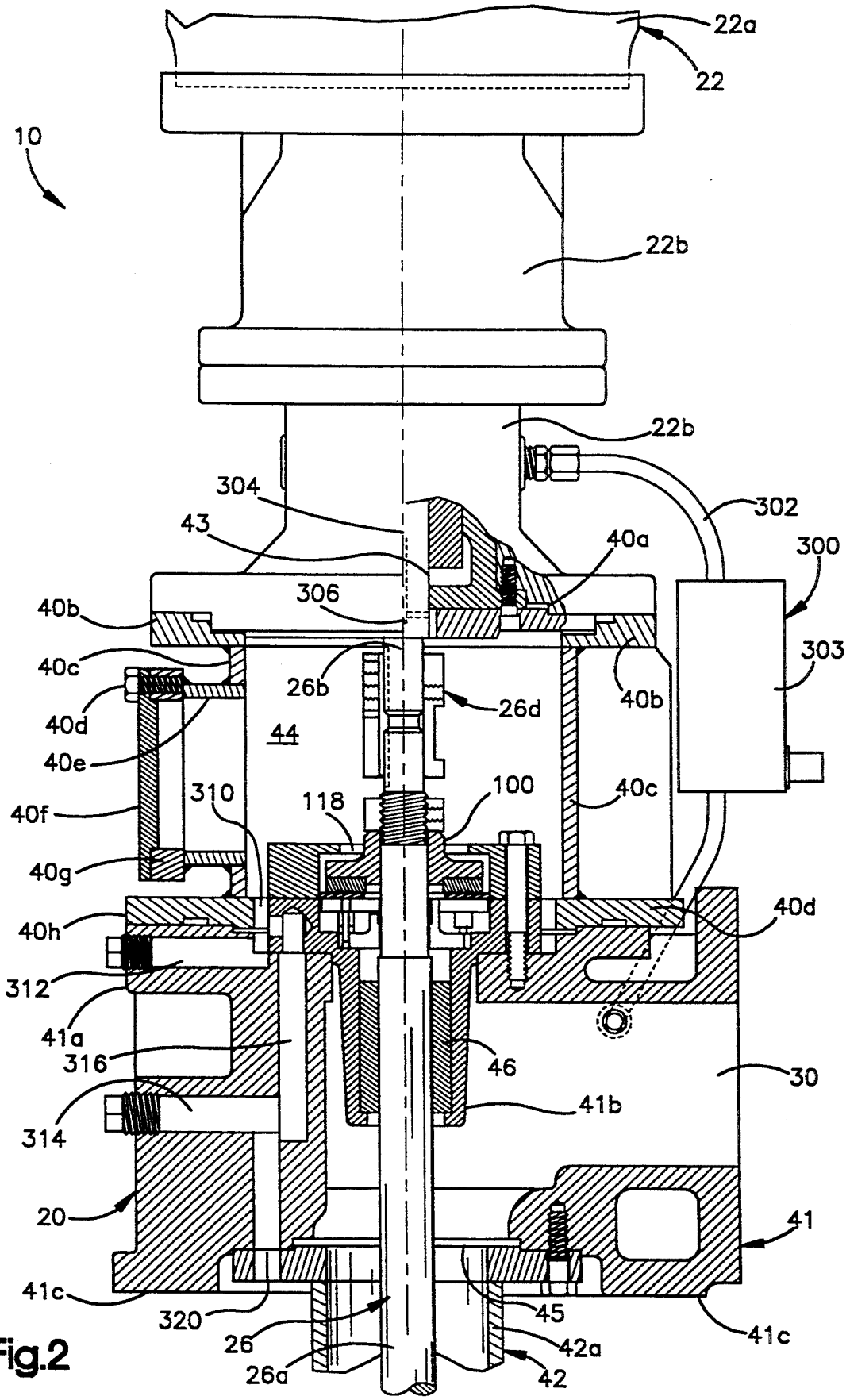
FIG. 2 is an enlarged view of certain components of the vertical turbine pump, some components being shown in plan and others being shown in section.

Referring now additionally to FIG. 2, certain portions of the vertical turbine pump 10 are illustrated in detail. As shown, the housing 20 may be viewed as generally comprising a first or drive-support portion 40, a second or discharge portion 41, and a third or column portion 42. These portions of the housing 20, and in fact almost all components of the pump 10, are preferably made of a suitable corrosion-proof material and more preferably are made of 316 stainless steel.

The structure of the first portion 40 is comprised of several sections of material 40A–40H, the shape, relative size and arrangement of which are best explained by referring to FIG. 2. As shown sections 40A–40H together define a cooling chamber 44, and may also define other optional features, such as an inspection cover. While other housing configurations are possible with, and contemplated by, the present invention, it should be noted that the sections 40A–40H are bolted, welded, or otherwise sealingly attached together. It should be additionally noted that the portion 40 is attached to the magnetic drive assembly 22, or perhaps more accurately, the drive assembly 22 is mounted on the upper surface of the section 40A. Consequently, the first portion 40 of the housing 20 includes a shaft-opening 43 through which the vertical shaft assembly 26 passes.

The second, or discharge, portion 41 of the housing 20 is located below the first portion 40, and it is also comprised of sections of material, such as sections 41A and 41B. As is best seen in FIG. 2, section 41A comprises a discharge head which defines the pump discharge outlet 30 and a column outlet 45, while section 41B comprises a central throttle bearing housing member in which a preferably babbitt graphite throttle-bearing 46 is located. These sections are bolted, welded, or otherwise sealingly attached to each other and to the first and third portions 40 and 42 of the housing 20. Additionally, the lower surface of the discharge head section 41A forms a mounting flange 41C for sealingly mounting the pump 10 to the tank 12.

The third, or column, portion 42 of the housing 20 is located below the second portion 41, and it basically comprises a flanged tubular section 42A and an impeller-interfacing section 42B which is located at the distal end thereof. As is best seen in FIG. 2, the upper flanged end of the tubular section 42A is sealingly attached to the second portion 41 of the housing 20. As is best seen in FIG. 1, the diffuser-bowl section 42B surrounds the periphery of the impeller assembly 24 and comprises a set of stationary diffusion blades. Consequently, the lower edges of the diffuser-bowl section 42B define the suction inlet 29 of the pump 10.

As was indicated above, one end section of the vertical shaft assembly 26 serves as an axial mount for the impeller assembly 24 and the other end section of the shaft 26 interfaces with the magnetic drive assembly 22. As such, the shaft assembly 26 may be viewed as including an impeller-rotating section 26A, a drive-interfacing section 26B, and a transfer section 26C therebetween. The impeller-rotating section 26A and the transfer section 26C are preferably formed in one integral piece, however, the drive-interfacing section 26B preferably comprises a separate component. In the illustrated and preferred embodiment, the lower end of the drive-interfacing section 26B is coupled to the upper end of the transfer section 26C by a shaft-coupling 26D which, as is explained in more detail below, coordinates with the down-thrust compensating device 100 to allow vertical adjustments of the impeller assembly 24.

The drive-interfacing section 26B of the shaft assembly 26 extends from the drive assembly 22, through the shaft-opening 43 and into the upper region of the cooling chamber 44 whereat it is joined with the transfer section 26C of the shaft assembly 26. The transfer section 26C then extends through the lower region of the cooling chamber 44, through the throttle-bearing 46, through the column outlet 45, and into the tubular section 42A of the housing 20. At a point corresponding to the transition between the tubular section 42A and the diffuser-bowl section 42B of the housing 20, the transfer shaft section 26C joins with the impeller-rotating section 26A of the shaft. The impeller-rotating section 26A extends downward to just above the pump suction inlet 29, or to just above the lower edges of the diffuser-bowl section 42B of the housing 20.

Figure 3:
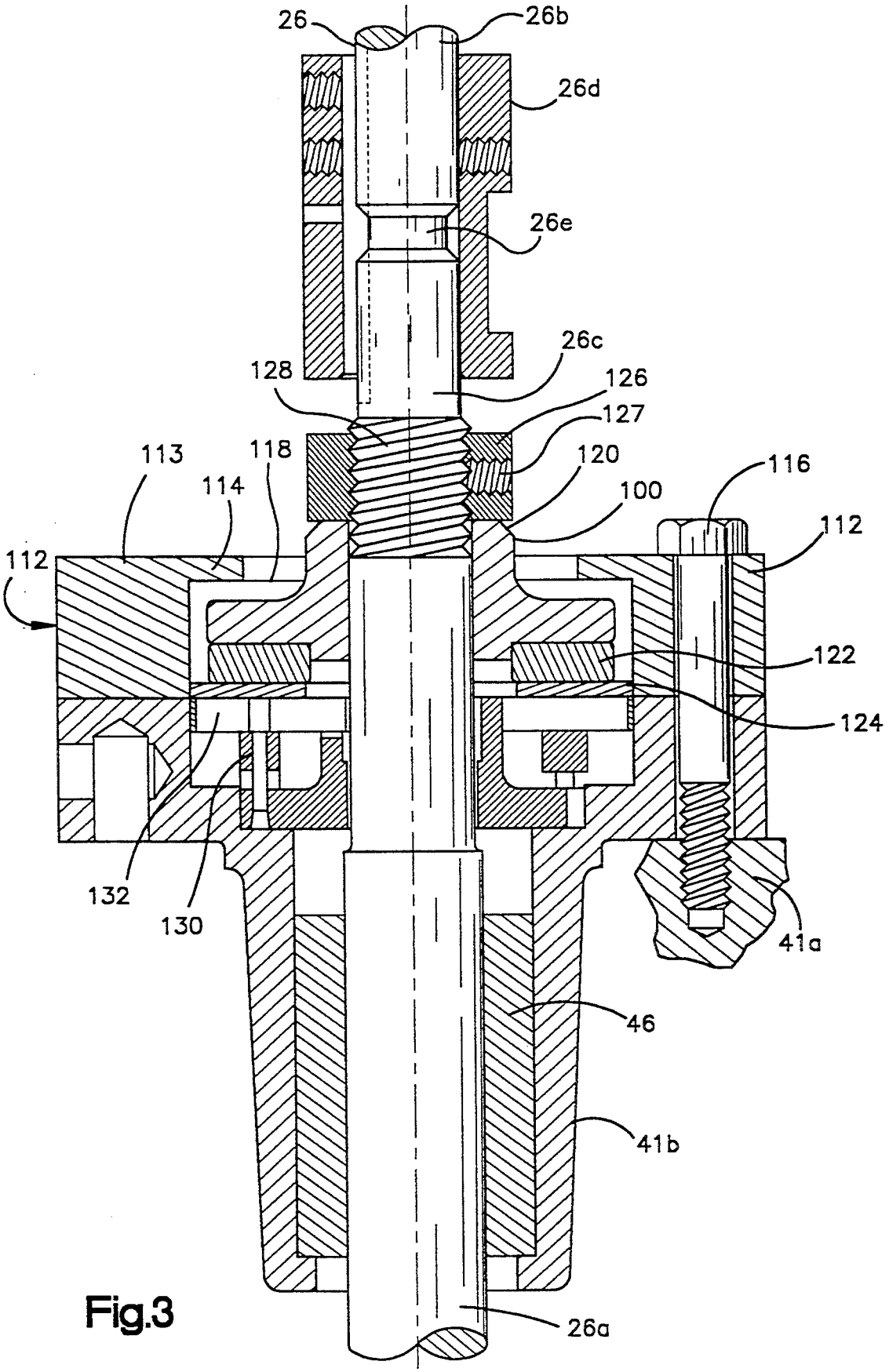
FIG. 3 is a further enlarged sectional view of certain components of the vertical turbine pump, namely a down-thrust compensating device and an impeller-adjusting device.

Referring now additionally to FIG. 3, the down-thrust compensating device 100 and certain adjacent sections of the housing 20 and the shaft assembly 26 are illustrated in detail. As shown; the thrust-compensating device 100 is situated above the impeller assembly 24 and below the magnetic drive assembly 22. More particularly, the thrust-compensating device 100 is installed on the transfer or transfer shaft section 26C in such a manner that it is located within the cooling chamber 44 and thus above the discharge outlet 30 of the pump.

It should be noted at this point that the term "down-thrust compensating device" corresponds to any device, regardless of whether it is equivalent to the disclosed device, which compensates for the down-thrust forces produced by the impeller assembly of a pump. In the preferred and illustrated embodiment, the down-thrust compensating device 100 generally includes a thrust-bearing assembly 110 and an upthrust-protecting assembly 112. The upthrust-protecting assembly 112 surrounds the thrust-bearing assembly 110 and acts as a safety stop to prevent the upward motion of the shaft assembly 26 during an emergency situation. To this end, the upthrust-protecting assembly 112 includes a generally annular-shaped body 113 and a safety flange 114 projecting inwardly therefrom. The safety flange 114 is sized and positioned to limit the upward motion of the shaft assembly 26 thereby inherently protecting the drive assembly 22 and the impeller assembly 24.

The upthrust-protecting assembly 112 is securely and fixedly coupled to the housing 20, and more particularly the second section 41, by suitable fasteners, such as the illustrated bolt 116. Consequently, the upthrust-protecting assembly 112 remains stationary and does not rotate with the shaft assembly 26 during the operation of the pump 10. It may be noted for future reference that the upthrust-protecting assembly 112 is specifically sized so that lubricating channels 118 are created between it and the thrust-bearing assembly 110.

The thrust-bearing assembly 110 preferably comprises a Kingsbury, or Michell, thrust bearing assembly. More particularly, the thrust-bearing assembly 110 includes a thrust block 120, a carbon shoe 122, and a set of stainless steel seats 124. The thrust block 120 is keyed to the shaft assembly 26 in such a manner that impeller adjustments are possible, and in the illustrated embodiment this keying is accomplished by a threaded coupling nut 126 and thus the appropriate region of the shaft assembly 26 is provided with threads 128. Once the impeller assembly 24 has been properly positioned relative to the housing 20, and more particularly the diffuser-bowl section 42B, a locking member (not shown) is inserted into the nut's locking slot 127 whereby the axial and radial position of the thrust block 120 will remain constant relative to the shaft assembly 26. As is explained in more detail below, the coupling nut 126 also coordinates with the shaft-coupling 26D to adjust the shaft assembly 26, and thus the impeller assembly 24, relative to the housing 20.

The carbon shoe 122 is fixedly secured to the bottom surface of the thrust block 120, and thus the carbon shoe 122 also rotates with the shaft assembly 26 during operation of the pump 10. The stainless steel seats 124 are fixedly mounted on the housing 20 whereby they do not rotate during the pumping process and instead remain rotationally stationary. However, the stainless steel seats. 124 are preferably mounted on a self-aligning equalizing base 130 which is secured to the bearing housing 41B and which includes a system of rocking levers. Although not apparent in the drawing due to the relative size of the components, it is important to note that the lubricating channel 118 communicates with a space between the carbon shoe 122 and the stainless-steel seats 124 whereby this space may be lubricated during the pumping process.

One may appreciate that the down-thrust compensating device 100 will absorb, or compensate, for down-thrust forces produced during the pumping process. In this manner, the drive-interfacing section 26B of the shaft assembly 26 will remain properly interfaced with the magnetic drive assembly 22, or will remain in a proper drive-interfacing position whereat rotational motion is magnetically conveyed from the magnetic drive assembly 22 to the impeller assembly 24. Additionally, the impeller assembly 24 will remain in proper interfacing position relative to the impeller-interfacing section 42B. Consequently, because the pump 10 may incorporate a magnetic drive assembly 22, it may be safely used to pump environmentally contaminating, explosives, or otherwise dangerous fluids.

In the preferred and illustrated embodiment, the down-thrust compensating device 100, or at least portions thereof, are designed to function as an impeller-adjusting device. The term "impeller-adjusting device" in this context corresponds to any device, regardless of whether it is structurally equivalent to the disclosed device, which selectively adjusts the shaft assembly 26, and thus the impeller assembly 24, in a vertical direction. More particularly, in the preferred and illustrated embodiment, the shaft-coupling 26D which couples the lower end of the drive-interfacing shaft section 26B to the upper end of the transfer shaft section 26C is designed so that the shaft sections 26B and 26C are non-rotatably secured to the coupling 26D, however selective axial or vertical adjustments are still possible.

The shaft-coupling 26D and the shaft assembly 26 are designed so that an adjustment-clearance 26E exists between the lower and upper ends of the shaft sections 26B and 26C, respectively, and this clearance is determinative of the overall length the shaft assembly 26. In this manner, a selective increase/decrease in the clearance 26E will increase/decrease the overall length of the vertical shaft assembly 26. Thus the components should be designed so that the vertical dimension of the adjustment-clearance 26E will accommodate the excepted range of impeller adjustments. Such adjustments may be necessary to ensure the proper orientation between the impeller assembly 24 and the diffuser-bowl section 42B of the housing when, for instance, a new pump is being prepared for initial operation or a used pump is being tuned after substantial wear.

As was alluded to above, the thrust-coupling nut 126 plays an important role in the impeller-adjustment process, and thus this component may also be referred to as the impeller-adjusting nut. The role the nut 126 plays specifically involves the ability to selectively, incrementally, and accurately, manipulate the shaft assembly 26 relative to the impeller-adjusting nut 126 once the locking member has been released from the locking slot 127. More particularly, as the threaded region 128 of the shaft assembly 26 is screwed into the nut 126, the adjustment-clearance 26E increases, and the overall length of the shaft assembly 26 increases. Conversely, as the threaded region 128 of the shaft assembly 26 is screwed out of the nut 126, the adjustment clearance 26E decreases, and the overall length of the shaft assembly 26 decreases.

Referring now back to FIG. 2, the cooling/lubricating system 300 of the pump 10 is shown. As an initial matter it may be noted that the cooling/lubricating fluid used in the system 300 consists of a small percentage of the working fluid 14. Thus, because the design of the pump 10 eliminates liquid and vapor leakage, an independent supply of cooling/lubricating fluid is not necessary when handling environmentally contaminating, explosive, or otherwise dangerous fluids. However if the working fluid 14 contains significant amounts of grit, a clean cooling/lubricating fluid may be desirable to avoid accelerated abrasion of the internal components of the pump 10.

The cooling lubricating system 300 includes an inlet line 302 which bleeds off a small percentage of the working fluid 14 slightly before it exits the pump through the discharge outlet 30. Because a proper supply of cooling/lubricating fluid is necessary to the proper functioning of the pump 10, the inlet line 302 may be provided with certain safety features to insure that such fluid is being adequately supplied. For example, an adjustable flow switch 303 could be provided which measures the flow rate through the inlet line 302 and which automatically shuts off the pump 10 if this flow rate drops below a predetermined value.

The inlet line 302 extends up to the lower region 22B of the drive assembly 22 and the lubricating/cooling fluid flows through this portion of the drive assembly thereby cooling the assembly. As should be apparent from FIG. 2, the drive-interfacing end section 26B of the shaft assembly is located within this region of the drive assembly 22. This location of the drive-interfacing shaft assembly section 26B allows the lubricating/cooling fluid to exit the drive assembly, and enter the pump housing 20, by traveling down through an axial bore 304 in the shaft section 26B and thereafter through a radial bore 306 which communicates with the cooling chamber 44.

During operation of the pump 10, the lubricating-/cooling fluid will fill the cooling chamber 44, and consequently pass through the lubricating channels 118 of the down-thrust compensating device 100. In this manner, the components of the device 100, such as the carbon shoe 122 and the stainless-steel seats 124, are provided with the necessary lubrication. From the cooling chamber 44, the cooling/lubricating fluid will travel through a passage 310 into the second, or discharge, portion 41 of the housing 20. While flowing through the second portion 41, the fluid will travel through cooling passages 312, 314, and 316, and thereafter through an outlet line 320 which returns the cooling/lubricating fluid to the tank 12.

One may now appreciate that the present invention provides a vertical turbine pump 10 which may be safely used with environmentally contaminating, explosive, or otherwise dangerous fluids. Although the pump 10 has been shown and described with respect to a certain preferred embodiment, it is obvious that equivalent alterations and modifications will occur to others skilled in the art upon the reading and understanding of this specification. The present invention includes all such equivalent alterations and modifications and is limited only by the scope of the following claims.

What is claimed is:

1. A vertical turbine pump, said pump being configured to pump fluid in a vertical direction whereat a vertical thrust compound is generated comprising: a housing, a magnetic drive assembly, a vertical shaft assembly, an impeller assembly, a thrust compensating mechanism including an up-thrust compensating device and a down thrust-compensating device;

said magnetic drive assembly being attached to said housing;

said vertical shaft assembly having an impeller-rotating section, a drive-interfacing section, and a transfer section therebetween;

said impeller assembly being mounted to said impeller-rotating section of said shaft assembly;

said housing including an impeller-interfacing section which interfaces with said impeller assembly;

said drive-interfacing section of said vertical shaft assembly being situated in a drive-interfacing position whereat rotational motion is magnetically conveyed from said magnetic drive assembly to said shaft assembly free of mechanical connection therebetween and thus to said impeller assembly;

said down-thrust compensating device including a thrust bearing assembly connected between said housing and said vertical shaft assembly for compensating for down-thrust forces produced by said impeller assembly during rotation and said up-thrust compensating device including a mechanism connected between this vertical shaft assembly and said housing for compensating for up-thrust force produced by said impeller assembly during rotation to thereby maintain said impeller assembly in a predetermined vertical interfacing position relative to said impeller-interfacing section of said housing, whereby vertical movement both downwardly and upwardly of the shaft assembly due to said thrust components is essentially eliminated.

2. A vertical turbine pump as set forth in claim 1 wherein said thrust-compensating device is installed on said transfer section of said vertical shaft assembly.

3. A vertical turbine pump as set forth in claim 2 wherein said thrust bearing assembly is installed on said transfer section of said vertical shaft assembly.

4. A vertical turbine pump as set forth in claim 3 wherein said thrust bearing assembly comprises a thrust block keyed to said shaft assembly, a shoe fixedly coupled to said thrust block, and a set of seats fixedly coupled to said housing.

5. A vertical turbine pump as set forth in claim 4 wherein said shoe is made of carbon and wherein said set of seats are made of stainless-steel.

6. A vertical turbine pump as set forth in claim 5 wherein said set of seats are mounted to said housing by a self-aligning equalizing base.

7. A vertical turbine pump as set forth in claim 6 wherein a space exits between said shoe and said seats and wherein said pump further comprises a lubricating system which supplies lubricating fluid to said space.

8. A vertical turbine pump as set forth in claim 1 wherein said upthrust-protecting assembly comprises a generally annular-shaped body and a safety flange projecting inwardly therefrom, said safety flange being sized and positioned to limit the upward motion of said thrust bearing and thus said shaft assembly attached thereto thereby inherently protecting said drive assembly and said impeller assembly.

9. A vertical turbine pump as set forth in claim 8 wherein said upthrust-protecting assembly is fixedly coupled to said housing.

10. A vertical turbine pump as set forth in claim 9 wherein said upthrust-protecting assembly is sized and positioned relative to said thrust-bearing assembly so that lubricating channels are created therebetween which communicate with said space between said shoe and said seats.

11. A vertical turbine pump as set forth in claim 10 wherein said thrust block is keyed to said shaft assembly in such a manner that impeller adjustment is possible without disturbing said thrust bearing assembly.

12. A vertical turbine pump as set forth in claim 1 further comprising an impeller assembly adjusting device which selectively adjusts said shaft assembly, and thus said impeller-rotating section, in a vertical direction.

13. A vertical turbine pump as set forth in claim 11 further comprising an impeller assembly adjusting device which selectively adjusts said shaft assembly, and thus said impeller assembly, in a vertical direction.

14. A vertical turbine pump as set forth in claim 13 wherein said impeller-rotating section and said transfer section of said shaft assembly are integrally joined and wherein said drive-interfacing section is a separate piece coupled to said transfer section by said impeller-adjusting device.

15. A vertical turbine pump as set forth in claim 14 wherein an adjustment-clearance exists between the lower end of said drive-interfacing section and the upper end of said transfer section.

16. A vertical turbine pump as set forth in claim 15 wherein said threaded coupling nut and said region of said shaft assembly are designed to selectively, incrementally, and accurately manipulate said shaft assembly, and thus said impeller assembly, relative to said diffuser-bowl section.

* * * * *

UNITED STATES PATENT AND TRADEMARK OFFICE

CERTIFICATE OF CORRECTION

PATENT NO. : 5,413,459

DATED : May 9, 1995

INVENTOR(S) : Woodall, et al.

It is certified that error appears in the above-indentified patent and that said Letters Patent is hereby corrected as shown below:

Title page, item [54] and col. 1, line,

In the title, please change [VERTICLE] to --VERTICAL--.

Signed and Sealed this

Eleventh Day of July, 1995

*Attest:*

*Attesting Officer*

BRUCE LEHMAN

*Commissioner of Patents and Trademarks*